United States Patent [19]

Gossling et al.

[11] 4,102,384

[45] Jul. 25, 1978

[54] WINDOW SHADE

[75] Inventors: Robert C. Gossling; Gerald W. Miller, both of Cincinnati, Ohio

[73] Assignee: Clopay Corporation, Cincinnati, Ohio

[21] Appl. No.: 785,368

[22] Filed: Apr. 7, 1977

Related U.S. Application Data

[63] Continuation of Ser. No. 688,063, May 19, 1976, abandoned.

[51] Int. Cl.[2] ..... A47G 5/02

[52] U.S. Cl. ..... 160/263

[58] Field of Search ..... 160/250, 263, 323 R, 160/326, 84 R

[56] References Cited

U.S. PATENT DOCUMENTS

| | | | |
|---|---|---|---|
| 3,203,468 | 8/1965 | Gossling et al. | 160/263 |
| 3,299,944 | 1/1967 | Gossling et al. | 160/263 |
| 3,308,874 | 3/1967 | Anderson | 160/326 |
| 3,580,323 | 5/1971 | Gossling | 160/263 |
| 3,913,655 | 10/1975 | Ogino | 160/84 R |
| 4,006,770 | 2/1977 | Ferguson | 160/263 |

*Primary Examiner*—Peter M. Caun

*Attorney, Agent, or Firm*—Wood, Herron & Evans

[57] ABSTRACT

This invention is directed to a window shade whose width can be decreased, without cutting instruments, to conform to the size of the window opening into which the shade is to be mounted. The window shade includes a roller and a shade secured to the roller having at one or both edges a plurality of spaced strip lines, preferably invisible, extending from end-to-end parallel to the shade edges. The strip lines permit hand-stripping of discrete widths of the shade while the shade is rolled on the roller. The roller includes, substantially coincident with the strip lines of the shade, a plurality of longitudinally spaced, circumferentially extending strip lines permitting removal of a corresponding discrete length of the roller. In accordance with the invention disclosed, the shade can be conveniently shortened by the consumer in the home, without the need for cutting of the shade, thus eliminating the need for cutting machines.

13 Claims, 8 Drawing Figures

WINDOW SHADE

This is a continuation of application Ser. No. 688,063 filed May 19, 1976, now abandoned.

BACKGROUND OF THE INVENTION

This invention relates to a window shade; and, more particularly, to a window shade which can be sized to a window when rolled without the need for cutting instruments.

The number of sizes of window openings into which window shades must be fitted is limitless. Practically all shades will be in the range of 25 to 72 inches in roller length, but there are window openings for every dimension within that range, and in older houses, the window openings are frequently less than 25 inches wide. In the application of shades to windows, the shades must conform to the window size rather than the window size conforming to the available size of shades manufactured. This is true not only for newly constructed buildings, but obviously also for those buildings which were erected many years ago. For these reasons, when a customer wants a shade, it is common practice to select an oversized shade and cut its length to conform to the size of the window opening into which the shade is to be mounted.

One type of shade roller now being manufactured includes a solid wooden roller or a hollow metal roller having, at one end, a spring motor connected between the roller and spear which is fixed against rotation in a slotted bracket. The other end of the roller has a cap containing a gudgeon pin which is fixed to the cap and which is adapted to be rotatably mounted in a bracket. A principal outlet for shades of this type and the place in which much of the cutting to size is performed is the variety, discount, or department store. The cutting of the shade to size in such an establishment is at best an annoying undertaking. For example, in the case of a wooden shade roller, the operation requires first pulling the pin and cap at the end of the roller, cutting through the shade material, unwinding the cut portion of the shade material, sawing the roller, chamfering the cut end of the roller and thereafter replacing the cap and pin. To minimize the difficulty, a machine is usually employed in which all of the operations described above are performed. Even with the machine, however, the shortening of window shades for the customer is regarded as a disagreeable and time-consuming task. Because of the number and difficulty of steps required to shorten the shade, it is not customary for this operation to be performed by the consumer in his home.

The window shades described and disclosed in U.S. Pat. Nos. 3,203,468; 3,299,944; and 3,580,323, all assigned to the assignee of this invention, provide improvements over prior art shades and methods of sizing. These shades comprise two sections, one being telescopable into the other for supporting the shade material so that the shortening of the shade can be effected merely by cutting the shade material and the slat running through the lower edge, sliding the cut material from the roller, and telescoping the projecting portion of the roller into its adjoining section. Shades of this type have eliminated much of the odium theretofore attending shade shortening by providing a structure which can be simply shortened by telescoping one section of the shade roller into another section. The advantage of the invention disclosed in the aforementioned patents are secured in part by providing a shade with telescoping roller, the combination having means for securing the upper edge of the shade material to the roller along its entire length while at the same time permitting one of the roller sections to telescope into the other. In one window shade form, for example, a tube of paper or other easily cuttable material is interposed between the smaller section of the roller and the shade material, the shade material being attached to the larger roller section and to the interposed tube. This interrelationship of roller sections and shade material provides the full support for the upper edge of the shade while permitting the smaller roller section to telescope into the larger one. The attachment of the shade to both the larger roller section and the tube fixes the tube against rotation with respect to the larger roller section. On the other hand, the fixed tube with the shade material attached prevents the shade material from drooping along the side depending from the smaller roller section and when it is cut, the tube can be slid from the roller.

Although the window shades described in the above patents offer significant improvements over prior devices with respect to the simplicity with which the shade can be shortened, they nevertheless require cutting machines or instruments to size the materials of construction. Such cutting operations require time consuming steps and care to permit proper sizing. While attempts have been made to provide window shades when the shade material is adapted to be severed by hand, such proposals still require a number of operations in order to size the shades and have been found less than satisfactory.

SUMMARY OF THE INVENTION

This invention consists of a unique article for accommodation in window openings of various sizes without the need for cutting instruments. The invention overcomes a number of problems heretofore associated with the prior art shades mentioned above. In accordance with the principles of the invention, the shade is secured to a roller and has at one or both edges a plurality of spaced, hand-strip lines extending from end-to-end, i.e., top-to-bottom, substantially parallel to its edges. The strip lines permit hand-stripping of discrete, predetermined widths of the shade while the shade is rolled on the roller without cutting of the shade material. Furthermore, according to this invention, the roller is provided with a plurality of longitudinally spaced, circumferentially extending strip lines substantially coincident with the lines of the shade material to permit removal of discrete lengths of the roller corresponding to the reduction in width of the shade. This invention thus eliminates the need for any cutting of the shade and the need for heretofore employed cutting machines whereby a window shade may be simply and conveniently shortened by the consumer in the home. Furthermore, according to this invention, the shade may be shortened without unrolling and the shortened shade has smooth, straight edges and hangs without drooping or wrinkling.

In the general aspect, this invention provides a window shade including a roller and a shade secured to the roller having at one or both edges a plurality of spaced, hand-strip lines extending from end-to-end substantially parallel to the edges. The roller includes at one or both ends a plurality of longitudinally spaced, circumferentially extending strip lines substantially coincident with the lines of the shade. The steps required to shorten the shade include simply grasping the shade at its base with the shade being in its rolled position on the roller, stripping off a desired width of shade material by unwinding the shade along a chosen strip line, and removing a corresponding length of material from the roller. The roller-shade assembly is thus conveniently shortened by hand.

The roller upon which the shade material is mounted may take several forms. For instance, the roller may simply comprise a length of material such as a tube of paper or plastic. Such a roller tube may further comprise motor and pin ends mounting means which are adapted for end mounting. Another roller form comprises telescoping members having at one or both ends strippable positions. Also, a telescoping roller assembly is provided with a tube of material onto which the shade material is secured. These forms and other forms of this invention will be discussed in more detail later in this description.

In one presently preferred form of the invention, the shade comprises a roller including a first tubular roller member, a second member having one end telescopingly seated within the first member and a tube surrounding the axially projecting portion of the second member and abutting the end of the first member to provide a smooth outer roller surface. The shade material is secured to the larger roller member and to the tube along substantially its entire width. The attachment of the shade to both the larger roller member and the tube fixes the tube against rotation with respect to the larger roller member. However, the attachment does not interfere with telescoping of the roller members. The fixed tube with the shade material attached prevents the shade material from drooping along the side depending from the smaller roller member. The tube has at its end the longitudinally spaced, circumferentially extending strip lines substantially coincident with the strip lines of the shade such that on sizing of the shade when the excess shade material is hand-stripped, a corresponding length of tube may be removed by sliding it over the end of the smaller roller member. The operation is complete by pushing the smaller roller member under the larger roller section.

In another embodiment of the invention, the telescoping roller members are provided with a tube surrounding both roller members and extending the entire length of the roller again providing a smooth outer roller surface. The shade is attached to the tube along its outer length. The tube is affixed to the larger roller member and extends about the smaller roller member to support shade material along the side depending from the smaller roller member. At this end, the tube is likewise provided with the circumferential strip lines for removal of a discrete tube length on sizing of the shade.

This invention further admits of use with window shades having a transversely symmetrical design whereby an equal amount of shade material may be hand-stripped from each edge of the shade and a like length of roller tube removed from each end of the roller to maintain the symmetry of the shade design in the shortened shade.

The invention further admits of the use of a roller tube having a removable pin and motor whereby replacement shades may be purchased without a pin and motor and be sized by hand-stripping as heretofore described in accordance with the invention, after which the pin and motor are inserted in the shade roller ends.

This invention is thus in contrast to other shades including features of a telescoping roller and a hand-strippable shade material. In known shades of this type, the shade material is initially attached only to the larger roller section with a contact adhesive concealed beneath a strip of paper being provided on the smaller roller section for eventual securing of the unattached shade portion to the smaller roller. The shade is shortened by completely unrolling the shade to expose the roller, holding the shade and the roller up to the window and adjusting the telescoping roller to fit the window brackets. The roller is thereafter removed from roller brackets and the roller and the excess shade material is removed by grasping the shade at a slit in the edge of the shade adjacent the roller. After the excess shade material is removed by pulling down along a strip line coinciding with the slit, the protective paper strip on the projecting end of the smaller roller is then removed, and the unattached portion of the shade material is pressed down on the adhesive. The shade must now be manually rolled up. Although this type of shade permits shortening without cutting, it requires a relatively large number of steps and is characterized by several distinct disadvantages. That is, in order for the shade to be sized, the shade material must be completely unrolled with the excess shade material being removed by stripping from the roller end of the shade towards its base. The shade must then be manually attached to the smaller end of the roller and then manually wound on the roller. One of the primary disadvantages, however, is that in shades of this type the shade has a tendency to droop over the larger roller onto the smaller roller making the shade unattractive in appearance and causing possible wrinkling of the shade on rolling.

In summary, the window shades of the present invention overcome the disadvantages associated with known shades heretofore described and permits shortening of the shade in substantially fewer steps while eliminating any drooping, wrinkling, etc. of the shade material. These and other advantages of the invention will be further appreciated by reference to the following detailed description and accompanying drawings.

DETAILED DESCRIPTION OF THE INVENTION

Figure 1:
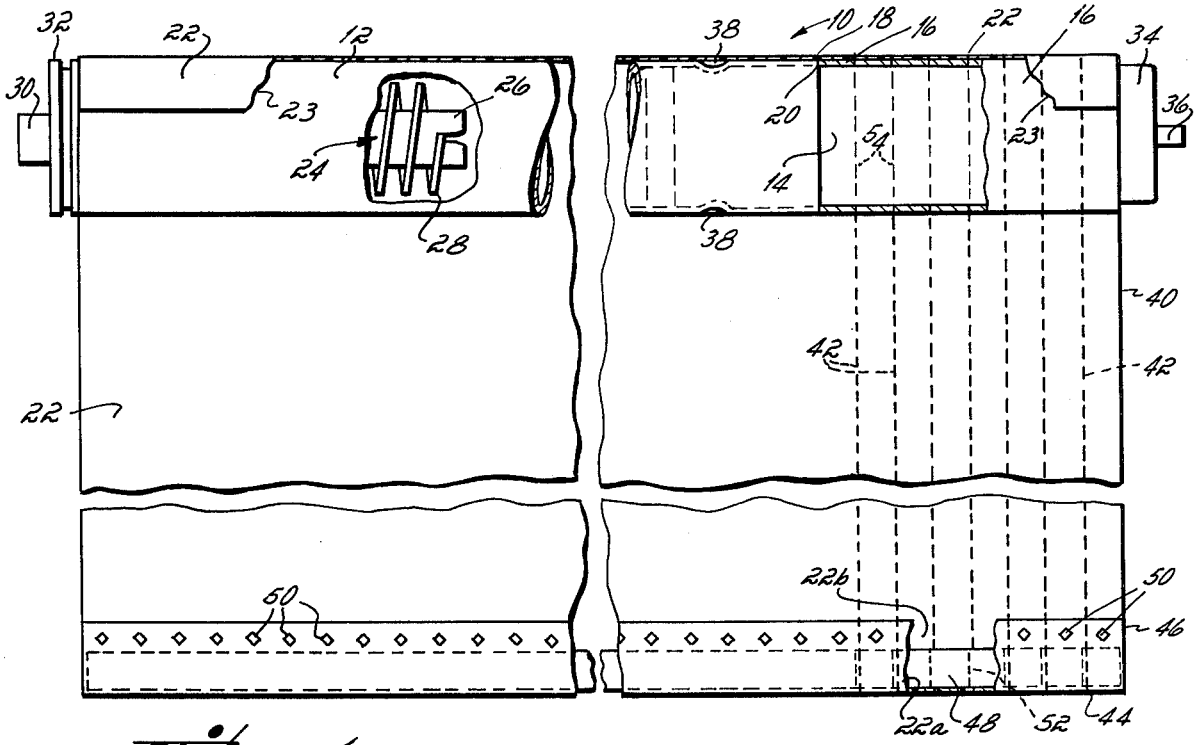
FIG. 1 is an elevational view, partly in section showing a preferred form of the invention.

Referring to FIG. 1, the window shade includes a roller 10 comprising a first tubular roller member 12, a second member 14, having one end thereof telescopingly seated within the first member 12, and a tube 16 surrounding the axially projecting portion of the second member 14. The tube 16 has the same inside and outside diameter dimensions as the first member 12, and the inside diameter is slightly larger than the diameter of the second member 14 allowing the second member 14 to freely telescope into the first member 12. The tube 14 abuts at one end 18 to the inner end 20 of the first member 12 forming a smooth outside roller surface extending from end-to-end of the roller 10. A roller of the type shown in FIG. 1 is disclosed in U.S. Pat. No. 3,203,468, and that disclosure is incorporated herein by reference.

A shade 22 is attached to the roller 10 along one end 23. The particular method of attachment is not critical, and a suitable method is by means of an adhesive strip as disclosed in U.S. Pat. No. 2,599,410. Alternatively, the shade could be attached in other known ways.

The left end of the roller 10, as viewed in FIG. 1, is adapted to receive a spring motor 24 which includes a torque rod 26 connected to one end of a rewind spring 28. The torque rod 26 is fixed to a spear 30 which projects from the left end of the roller 10 and is engageable with a flat slot of a window shade bracket by which the window shade is supported in the window opening. A cap 32 encloses a clutch and other operating mechanism (not shown) through which the spring and torque rod are connected to the roller to rotate the roller in winding the shade 22 on the roller 10. At the right hand end of the shade, the roller 10 is adapted to receive a pin end plug or cap 34. Projecting from the pin end cap 34 is a cylindrical gudgeon pin 36 which is engageable with and rotates in the other of the window brackets supporting the window shade in the window opening. Preferably, the pin end cap 34 has the same or slightly smaller diameter as the second member 14 to permit the tube portion separated in the shortening operation to be slid off the roller without obstruction by the pin end cap.

The particular means by which the telescoping second member 14 is seated in the first member 12 is not critical. For example, with a metal tubular first member and a wooden dowel or plastic cylinder forming the second member, the dowel may be held in the steel roller principally by dimples 38 which are depressed into the surface of the metal roller a distance sufficient to cut into the soft wooden dowel as it is forced into the metal roller. The dimples prevent both axial and rotative movement of the second member with respect to the first. With an all metal roller, a convenient form of mounting is that described in U.S. Pat. No. 3,203,468, particularly in relation to FIG. 10, wherein the smaller roller formed from sheet metal is seamed to provide a longitudinal groove adjacent the seam into which the seam of the larger roller member is keyed. The cooperation between the seam and the groove prevents relative rotation of the two roller members.

In the embodiment shown in FIG. 1, the tube 16 is not affixed to the second member 14. The adhesive securing the shade 22 to the first roller member 12 and to the tube 16 holds the tube 16 in proper position with respect to the first roller member 12 so that the tube 16 forms in effect an extension of the first member 12. The adhesive prevents the paper tube from rotating with respect to the first member, and the tube prevents any drooping of the shade material.

The shade 22 at its one edge 40 includes a plurality of spaced, hand-strip lines 42 extending from one end, i.e., the base of the shade 44 to the opposite end 23 secured to the roller 10. The lines 42 are substantially parallel to the edge 40 of the shade and are separated by a predetermined distance to permit decreasing of shade width by any amount up to the total or sum of separations. For example, the shade may conveniently be formed with 24 strip lines separated by one half inch increments thus permitting shortening of the shade from ½ inch up to 12 inches. At the base 44 of the shade 22 is a hem 46 into which a slat 48 is inserted for grasping for raising and lowering the shade. The hem 46 is formed by joining the overlapping portions *22a, 22b* of the shade at points 50 intermediate the hand-strip lines 42 and continuing on at equalled spaced intervals for the remainder of the shade width. The slat 48 includes a plurality of spaced lines 52, e.g., perforations, serrations, or the like providing lines of weakness, preferably coincident with the film lines, to permit the convenient breaking off of excess slat length on shortening of the shade. The slat may be telescoping.

The particular manner of forming the strip lines in the shade 22 is not critical to the invention and may comprise any of a number of known methods of weakening material along a line permitting hand-stripping of the material along the line while leaving a smooth straight edge. For example, in woven shades, strip lines may be formed during the weaving process by some means of fiber orientation or thereafter by perforating or serrating the shade material along a line. In shades formed of plastic material, the lines may be formed by weakening the material along a line or by such mechanical means as perforating or serrating or by decreasing the thickness of the shade material along continuous lines. Although any means is suitable when a smooth shade material is provided, it is desirable that the lines be invisible to maintain the aesthetic appeal of the shade. Where the shade material is patterned or embossed the lines may form a part of the pattern and thus, even though visible, do not noticeably affect the aesthetics of the shade.

In the embodiment shown in FIG. 1, the shade 22 is formed of plastic with the overlying portions *22a, 22b* of the shade at its base 44 being joined by heat sealing at points 50 intermediate the strip lines 42 to form the hem 46.

The tube 16 is also provided with a plurality of strip lines 54 longitudinally spaced along the tube 16 and extending about the circumference of the tube to permit removal of a discrete length of roller tube corresponding to the decrease in shade width. These lines are so aligned as to be substantially coincident with the strip lines 42 of the shade when the shade is secured to the roller 10. These lines 54 may be formed by perforating, serrating or otherwise weakening the tube. For example, if the tube is formed of a cuttable paper material it may be conveniently serrated or perforated about its circumference. Tubes formed of plastic or metal may be mechanically weakened along circumferential lines, for example, to allow separation of tube length by grasping of the shade and twisting off the unwanted section or sections.

Figure 2:
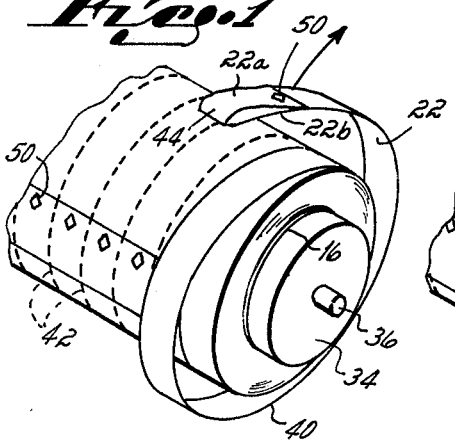
FIGS. 2–4 illustrate the steps of shortening a shade in accordance with the present invention.
Figure 3:
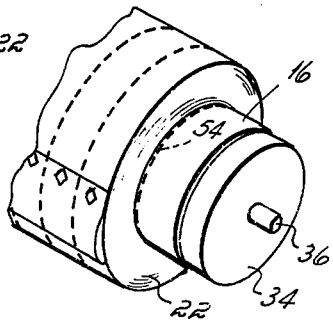
Figure 4:
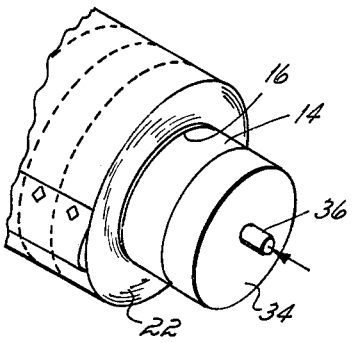

In shortening the shade to the desired size only a few simple steps are required. The desired shade length is determined by measuring the window opening or by placing the shade against the window opening to determine the strip line 42 corresponding to the window opening at which the shade is to be shortened. The slat 48 is slid axially out of the hem 46 a distance sufficient to allow the excess shade material to be stripped. With the shade in the rolled condition, the material is grasped at the base 44 and separated along the chosen strip line. As shown in FIG. 2, stripping commences at the base 44 of the shade and proceeds by unwinding of the shade material with the material following the strip line 42 until it reaches the roller tube 16. This operation can be done quite rapidly. At the tube 16, the material is ripped to separate it from the adhesive thus exposing its corresponding length of roller tube 16 to be removed (FIG. 3). This section of roller tube 16 is removed by, for example, twisting the tube section off or, in the case of a cuttable paper tube, by cutting the tube along the circumferential strip line with a household paring knife. Since the tube 16 has an inside diameter slightly greater than the diameter of the second member 14, the excess tube length is easily slid over the end of the second member and the pin end cap 34. The last step required is illustrated in FIG. 4 and consists of merely pushing the second member 14 into the hollow first member 12. The force required to push the second member 14 into the first member is slight enough to be done by hand. The hem slat is now replaced and the excess length is broken off at the closest line of weakness.

Figure 5:
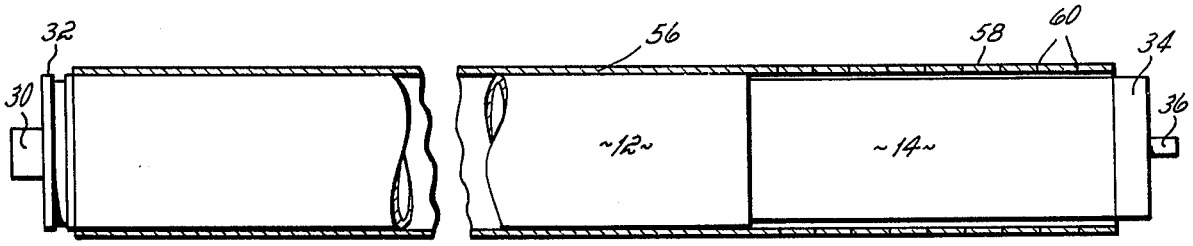
FIG. 5 is a cross-sectional view showing an embodiment of the invention in which a tubular roller member extends the entire length of the roller.

Referring now to FIG. 5, a second embodiment of the invention is illustrated wherein the roller tube 16 is replaced with a similar tube 56 which extends the entire length of the roller 10. That is, the tube 56 has an inside diameter slightly greater than that of the first roller member 12 allowing it to be slid over the first member 12. An adhesive is applied between the inside diameter of the tube 56 and first member 12 to secure the tube thereto to prevent relative rotative movement between the two elements. The first and second roller members 12 and 14, respectively, are identical to those described in relation to FIG. 1.

The tube 56 extends from the motor cap 32 over the axially projecting portion of the second member 14 to the pin end cap 34 providing a smooth outer roller surface. The shade is secured to the roller tube 56 along its entire length. The tube 56 is formed of such material and thickness to provide support for the shade secured thereto so as to prevent dropping from the second member. As described in relation to FIG. 1, one end 58 of the tube 56 is provided with a plurality of longitudinally, spaced circumferentially extending strip lines 60 substantially coincident with the strip lines 42 of the shade 22 whereby discrete lengths of the tube may be removed after stripping of the shade material in the same manner as described in relation to FIGS. 2 and 3. Thereafter, as described in relation to FIG. 4, the second member 14 may be pushed into the first member 12.

Figure 6:
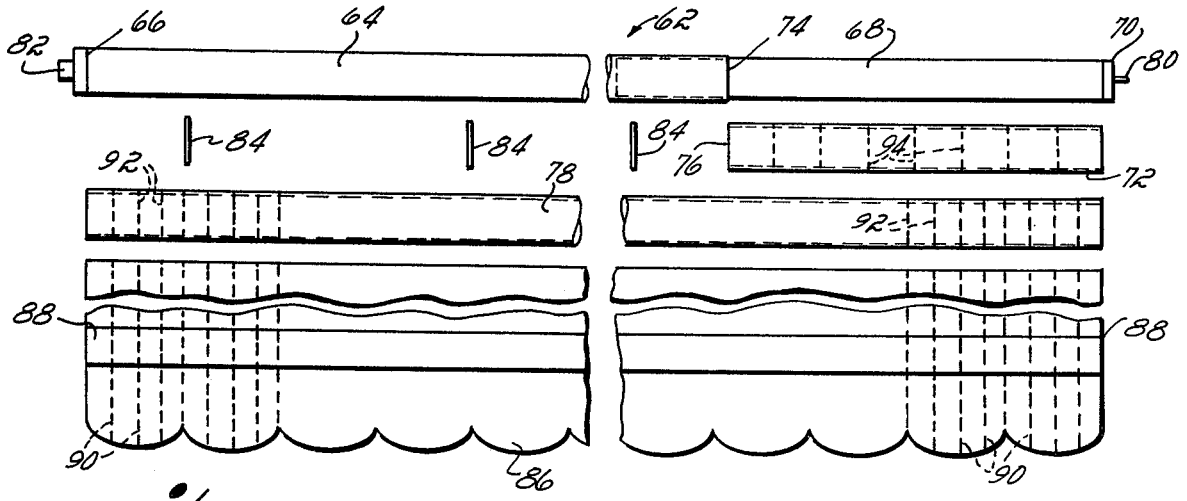
FIG. 6 is an exploded view illustrating another embodiment of the invention.

In the embodiment shown in FIG. 6, there is provided a hand-strippable window shade having provision for permitting the shade to be shortened to conform to the size of the window opening into which the shade is to be mounted while maintaining the transverse symmetrical design of the shade. This embodiment employs the telescoping roller described and disclosed in U.S. Pat. No. 3,580,323, and that disclosure is incorporated by reference herein. This roller 62 includes a first tubular roller member 64 having a motor receiving end 66, a second roller member 68 telescopingly seated at one end within the first roller member 64 and having a pin receiving opposite end 70, a first tube 72 surrounding the axially projecting portion of the second member 68 and abutting the end 74 of the first member 64 at its end 76, and a second tube 78 extending the length of the roller members surrounding both the first roller member 64 and the first tube 72. Again, the roller members 64 and 68 may be identical to the construction described above in relation to FIG. 1 with the end 70 of the second member 68 carrying a conventional gudgeon pin 80 and the end 66 of the first member having the usual flat spear 82 by which the assembly may be mounted in conventional window shade brackets.

The second tube 78 is secured to the first roller member 64 so as to prevent relative rotation movement between the two elements by means of a plurality of spaced rubber bands 84 inserted therebetween. The rubber bands 84 frictionally engaging both tubes to prevent rotation. However, they do permit axial movement of the second tube 78 with respect to the first roller member 64. The shade 86 is secured along one end, e.g., by means of an adhesive strip, to the second tube 78 which either alone or in combination with the second tube 72 prevents drooping of the shade 86.

As further shown in FIG. 6, the shade 86 at its lateral edges 88 is provided with the spaced, hand-strip lines 90 extending from end to end substantially parallel to the edges 88 of the shade. The second tube 78 is provided at both ends with the plurality of longitudinally spaced, circumferentially extending strip lines 92 which are substantially coincident with the hand-strip lines 90 of the shade when the shade is secured to the roller. The first tube 72 is also provided at its one end with like, coincident strip lines 94. Provision of strip lines at both edges of the shade 86 and ends of the roller 92 allows a window shade having a transverse symmetrical design, e.g., a scalloped base illustrated in FIG. 6, to be sized to a window opening without destroying the symmetry. That is, if sizing could only be done from one end then the sizing operation would destroy the symmetry of the design. However, by removing equal widths of shades from both ends, the symmetry is maintained.

In the sizing operation, the amount of excess shade material to be removed is first determined by measuring the window opening or by placing the shade in its rolled condition up against the window to determine the width of shade material to be removed from both ends. The hem slat, if present, is removed and the shade is grasped at the hem at the chosen strip line, and the shade is unwound along this strip line. This operation is repeated at the opposite end of the shade. With both edges stripped, the ends of the second tube are now exposed and the excess tube length at both ends may be separated along a coincident strip line and the excess slid over the ends of the roller members. This exposes the excess tube length at the end of the first tube and it is removed in the same manner. The telescoping second member is now pushed into the first member 64 and the second tube 78 is adjusted axially on the first member 64 such that the shade extends from end-to-end of the roller 62.

This embodiment of the invention in FIG. 6 thus permits the removal of equal amounts of shade material from each end of the window shade to preserve the overall symmetry of the design. It will be appreciated, however, that the shortening operation may be made by hand-stripping material from one end only when preserving design symmetry is not required. It will be further appreciated that employment of the first tube 72 is optional and that means other than rubber bands 84 may be employed so long as the means has the characteristic of permitting relative longitudinal shifting movement between the first roller member 64 and the second tube 78 while preventing relative rotational movement between these two elements.

Figure 7:
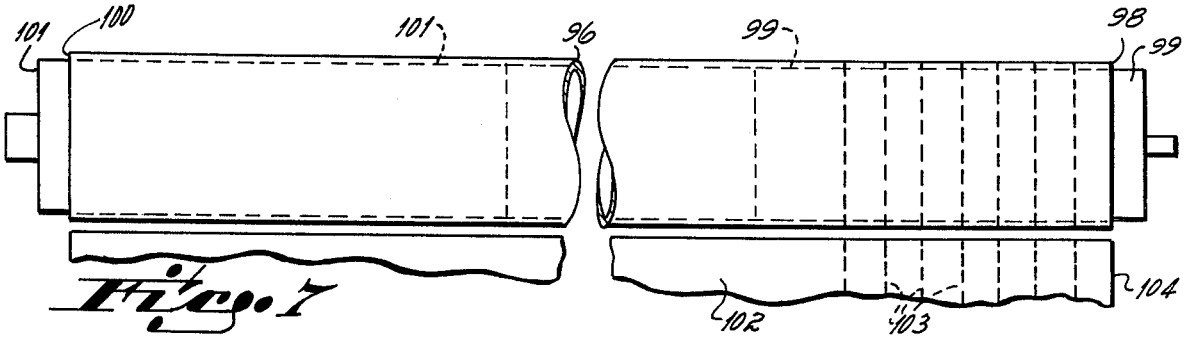
FIG. 7 is an elevational view illustrating another embodiment of the invention.

Referring now to FIG. 7, there is shown another embodiment of the invention comprising a tubular roller 96 having a pin receiving end 98 and a motor receiving end 100. The ends 98 and 100 are adapted to receive a removable pin 99 and motor 101, respectively, such that both elements may be inserted in the ends of the tube 96 and removed therefrom simply by grasping the pin or spear and pulling outwardly. The mounting means for the pin and motor is not critical to the invention but includes suitable means for maintaining their axial positions while preventing rotation of these elements when inserted in the tube ends.

A shade 102 is attached to the tube 96 and includes the plurality of spaced, hand-strip lines 103 extending from end-to-end substantially parallel to the edge 104 of the shade. The tube 96 is provided at one end with substantially coincident, longitudinally spaced, circumferentially extending strip lines adapted to permit removal of discrete lengths of the tube in accordance with the invention.

In this embodiment of the invention, the shade is shortened in the same manner as heretofore described. That is, the shade is grasped at the base and the excess shade width is hand-stripped along the strip line to the roller tube 96 exposing the tube. The corresponding length of tube is then removed over the end 98 of the roller. After removal of this tube length, the pin 99 is then pushed into the tube 96.

In the embodiment illustrated in FIG. 7, shortening is accomplished at only one end of the shade roller. However, it will be appreciated that the motor end may be made removable also with shortening of the shade accomplished at both ends in like manner. The embodiment shown in FIG. 7 is particularly useful in permitting replacement of shades without the need for purchasing rollers or mounted motors and pins. That is, the motor and pin in an existing shade can be simply removed and inserted in the ends of a replacement window shade with the tube being shortened in accordance with the principles of the invention before insertion of the motor and pin.

Figure 8:
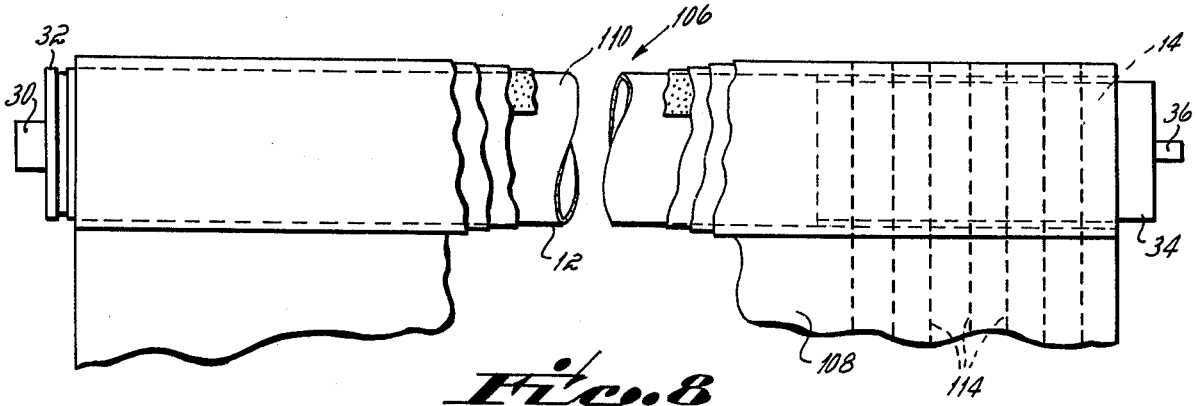
FIG. 8 is an elevational view illustrating another embodiment of the invention.

Referring now to FIG. 8, a telescoping roller 106 is provided identical to that described in relation to FIG. 5. The shade 108 is secured to the larger roller member 110, for example, by means of an adhesive strip, and the shade 108 is then rolled upon itself twice with adhesive therebetween as indicated by the stipling in FIG. 8. In wrapping the shade upon itself two times, a tube is formed which extends over the smaller telescoping roller member 112 and holds the shade material securely to the roller 106 over that area without any drooping and at the same time permitting the smaller member 112 to freely telescope to the larger member 110.

The method of shortening the shade is the same as that previously described wherein the shade is shortened from its base along a strip line 114 toward the roller 106 until the tube is reached. Further unwinding of the shade material severs the tube along coincident strip lines which are longitudinally spaced along the tube and circumferentially extending by virtue of the shade being rolled on itself.

Having described this invention in its presently contemplated best mode, it will become apparent to those of ordinary skill that obvious variations may be made in view of the above description to obtain the benefits thereof.

What is claimed is:

1. A window shade comprising, in combination, a roller having a telescoping member receivable in one end, and a shade secured along one end to said roller and extending between the ends of said roller and having a free opposite end, said shade having at least at one edge thereof a plurality of spaced hand-strip lines extending from end-to-end substantially parallel to said edge such that discrete widths of said shade may be hand-stripped along said lines from said free end of said shade to provide a smooth, straight edge after stripping, said roller including at least at its end receiving the telescoping member a plurality of longitudinally spaced, circumferentially extending strip lines substantially coincident with said lines of said shade adapted to permit removal of discrete lengths of said roller corresponding to said discrete widths of said shade hand-stripped therefrom, said window shade being adapted to be sized to a window opening by hand-stripping of said discrete widths of said shade from said free end of said shade toward said end secured to said roller while said shade is rolled on said roller, with said discrete length of said roller to be removed being exposed by said hand-stripping of said shade.

2. The window shade of claim 1 wherein said roller further comprises a pin member and a motor member.

3. A window shade comprising, in combination, a roller comprising a first tubular roller member, a second member having one end thereof telescopingly seated within said first member, a tube surrounding at least the portion of said second member projecting axially from said first member, and means associated with said tube for resisting relative rotative movement between said tube and said members, said tube having an inside diameter of a size permitting free axial sliding movement between said members, and a shade secured along one end to said roller and extending between the ends of said roller and having a free opposite end, said shade having at least at one edge thereof a plurality of spaced hand-strip lines extending from end-to-end substantially parallel to said edge such that discrete widths of said shade may be hand-stripped along said lines from said free end of said shade to provide a smooth, straight edge after stripping, said tube including at least at one end thereof a plurality of longitudinally spaced, circumferentially extending strip lines substantially coincident with said lines of said shade adapted to permit removal of discrete lengths of said tube corresponding to said discrete widths of said shade hand-stripped therefrom, said window shade being adapted to be sized to a window opening by hand-stripping of said discrete widths of said shade from said free end of said shade toward said end secured to said roller while said shade is rolled on said roller, with said discrete length of said tube to be removed being exposed by said hand-stripping of said shade.

4. The window shade of claim 3 wherein said tube has an outside diameter approximately equal to the outside diameter of said first member and has one end thereof abutting the end of said first member surrounding said second member.

5. The window shade of claim 3 wherein said tube is formed of a readily cuttable material.

6. The window shade of claim 4 wherein said shade is secured to said roller by means of an adhesive extending between the ends of said roller.

7. The window shade of claim 3 wherein said tube surrounds said first roller member and extends the length of said roller.

8. The window shade of claim 7 wherein said tube is formed by said shade being wrapped about and secured to itself across its width.

9. A window shade comprising, in combination, a roller comprising a first tubular roller member, a second member having one end thereof telescopingly seated within said first member, a tube surrounding said members and extending the length of said roller, and means associated with said tube and said first roller member for resisting relative rotative movement between said tube and said first member, while permitting relative longitudinal movement therebetween, and a shade secured along one end to said tube and extending between the ends of said roller and having a free opposite end, said shade having at least at one edge thereof a plurality of spaced hand-strip lines extending from end-to-end substantially parallel to said edge such that discrete widths of said shade may be hand-stripped along said lines from said free end of said shade to provide a smooth, straight edge after stripping, said tube including at least at one end thereof a plurality of longitudinally spaced, circumferentially extending strip lines substantially coincident with said lines of said shade adapted to permit removal of discrete lengths of said tube corresponding to said discrete widths of said shade hand-stripped therefrom, said window shade being adapted to be sized to a window opening by hand-stripping of said discrete widths of said shade from said free end of said shade toward said end secured to said roller while said shade is rolled on said roller, with said discrete length of said roller to be removed being exposed by said hand-stripping of said shade.

10. The window shade of claim 9 wherein said shade has at both edges thereof said plurality of spaced hand-strip lines and said tube has at both ends thereof said circumferentially extending strip lines.

11. A method of installing a window shade including a roller having a telescoping member receivable in one end, and a shade rolled on said roller, said shade being secured along one end to said roller and extending between the ends of said roller and having a free opposite end and having at least at one edge thereof a plurality of spaced hand-strip lines extending from end-to-end substantially parallel to said edge such that discrete widths of said shade may be hand-stripped along said lines from said free end of said shade to provide a smooth, straight edge after stripping, said roller including at least at its end receiving the telescoping member a plurality of longitudinally spaced, circumferentially extending strip lines substantially coincident with said lines of said shade adapted to permit removal of discrete lengths of said roller corresponding to said discrete widths of said shade hand-stripped therefrom; said method comprising the steps of:

marking the desired width of the shade, hand-stripping said shade along the hand-strip line closest to the marked width of the shade, said hand-stripping commencing at said free end of said shade and continuing towards said end secured to said roller by unwinding of said discrete width of said shade as it is hand-stripped until said discrete length of said roller is exposed, removing said discrete length of said roller, and adjusting the telescoping member to the hand-stripped width of the shade.

12. A method of installing a window shade including a roller and a shade rolled on said roller, said roller comprising, a first tubular roller member, a second member having one end thereof telescopingly seated within said first member, a tube surrounding at least the portion of said second member projecting axially from said first member, and means associated with said tube for resisting relative rotative movement between said tube and said members, said tube having an inside diameter of a size permitting free axial sliding movement between said members, said shade being secured along one end to said roller and extending between the ends of said roller and having a free opposite end and having at least at one edge thereof a plurality of spaced hand-strip lines extending from end-to-end substantially parallel to said edge such that discrete widths of said shade may be hand-stripped along said lines from said free end to said shade to provide a smooth, straight edge after stripping, said tube including at least at one end thereof a plurality of longitudinally spaced, circumferentially extending strip lines substantially coincident with said lines of said shade adapted to permit removal of discrete lengths of said tube corresponding to said discrete widths of said shade hand-stripped therefrom; said method comprising the steps of:

marking the desired width of the shade, hand-stripping said shade along the hand-strip line closest to the marked width of the shade, said hand-stipping commencing at said free end of said shade and continuing toward said end secured to said roller by unwinding of said discrete width of said shade as it is hand-stripped until said discrete length of said tube is exposed, removing said discrete length of said tube, and adjusting the telescoping roller members to the hand-stripped width of the shade.

13. The method of claim 12 wherein said discrete length of tube is removed by twisting to separate it from the remainder of the tube and sliding it off the end of said roller.

* * * * *

UNITED STATES PATENT AND TRADEMARK OFFICE

CERTIFICATE OF CORRECTION

PATENT NO. : 4,102,384

DATED : July 25, 1978

INVENTOR(S) : Robert C. Gossling et al

It is certified that error appears in the above-identified patent and that said Letters Patent are hereby corrected as shown below:

On the cover sheet, "13 claims" should read -- 12 claims --.

Col. 1, lines 66 and 67, "advantage" should be --advantages--

Col. 8, line 2 "rotation" should be --rotative--

Col. 10, lines 64 and 65, cancel Claim 5

Col. 12, line 33 "to" should be --of--

Col. 12, line 45 "stipping" should be --stripping--

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*